US010095154B2

(12) United States Patent
Seki

(10) Patent No.: US 10,095,154 B2
(45) Date of Patent: Oct. 9, 2018

(54) LIGHT SCANNING APPARATUS

(71) Applicant: CANON KABUSHIKI KAISHA, Tokyo (JP)

(72) Inventor: Yuichi Seki, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/606,744

(22) Filed: May 26, 2017

(65) Prior Publication Data

US 2017/0357174 A1 Dec. 14, 2017

(30) Foreign Application Priority Data

Jun. 8, 2016 (JP) ..... 2016-114398

(51) Int. Cl.
*G03G 15/00* (2006.01)
*G03G 15/043* (2006.01)
*G03G 15/02* (2006.01)

(52) U.S. Cl.
CPC ..... *G03G 15/043* (2013.01); *G03G 15/0266* (2013.01)

(58) Field of Classification Search
CPC ..... G03G 15/043; G03G 2215/0404
See application file for complete search history.

(56) References Cited

U.S. PATENT DOCUMENTS 6,560,256 B1 5/2003 Seki et al. ..... 372/38.02
6,919,979 B2 7/2005 Seki et al. ..... 359/204
7,106,770 B2 9/2006 Seki ..... 372/43
7,129,967 B2 10/2006 Seki et al. ..... 347/249
7,586,511 B2 9/2009 Seki et al. ..... 347/249
8,305,416 B2 11/2012 Maeda ..... 347/237
8,963,978 B2 2/2015 Seki ..... G03G 15/043
9,091,955 B2 7/2015 Seki ..... G03G 15/04072
2011/0228037 A1* 9/2011 Omori ..... G03G 15/043 347/247
2017/0052473 A1 2/2017 Seki et al. ..... G03G 15/043
2017/0075250 A1 3/2017 Seki ..... G03G 15/043
2017/0139342 A1 5/2017 Seki ..... G03G 15/043

FOREIGN PATENT DOCUMENTS

JP 5629975 11/2014

* cited by examiner

*Primary Examiner* — Erika J Villaluna
(74) *Attorney, Agent, or Firm* — Fitzpatrick, Cella, Harper & Scinto

(57) ABSTRACT

A light scanning apparatus, including: a light source configured to emit a light beam; a light intensity detection portion configured to detect a light intensity of the light beam; and a light intensity control portion configured to control the light intensity of the light beam based on a detection result of the light intensity detection portion, wherein the light intensity control portion supplies, in advance, to the light source, a bias current equal to or less than a threshold current at which the light source starts emitting the light beam, and supplies, to the light source, a switching current superposed on the bias current, the switching current being modulated in order to control light emission of the light source in accordance with an image signal, and wherein the light intensity control portion includes a bias current changing unit configured to change the bias current.

3 Claims, 9 Drawing Sheets

LIGHT SCANNING APPARATUS

BACKGROUND OF THE INVENTION

Field of the Invention

The present invention relates to a light scanning apparatus that includes a light intensity control portion configured to control the intensity of a light beam.

Description of the Related Art

Some known light scanning apparatus provided in an image forming apparatus use a method of irradiating a photosensitive drum via an fθ lens with a light beam that is deflected by a rotary polygon mirror after exiting a light source. In recent years, image forming apparatus have been demanded to form a high quality image at high speed and, to meet the demand, use as a light source a multi-beam light source, which is configured to emit a plurality of light beams concurrently from a plurality of light emitting points.

Meanwhile, light scanning apparatus switch the rotation speed of the rotary polygon mirror and the number of light emitting points of the light source in response to a change in printing speed (variable speed), a change in image resolution, or a change in the rotation speed of the photosensitive drum which depends on the thickness of the recording medium in a manner that suits the new printing speed, the new image resolution, or the new drum rotation speed. In Japanese Patent No. 5629975, there is disclosed light intensity control under which light for an image forming area on a surface of the photosensitive drum is emitted from a smaller number of light emitting points that is suited to image data, and light for a non-image forming area on the drum surface is emitted from all light emitting points on light emission schedules different from one another.

However, in the case where the number of light beams is switched by using laser drive circuit boards of the same type in which control for supplying a bias current to a plurality of light emitting points is executed in order to improve the light beam output response for different types of light scanning apparatus, a bias current is supplied also to a light emitting point that is not in use. This presents a difficulty in reducing the power consumption of the light scanning apparatus. When the light source used is a VCSEL or another light source that emits a large number of light beams, power consumption due to a bias current supplied to light emitting points that are not in use is particularly large, which is a problem. This is one of cases where it is desired to reduce a bias current supplied to a light emitting point that is not in use. Meanwhile, there are cases where it is desired to increase a bias current as close to the threshold current (light emission start current) of a light emitting point as possible in order to prevent an image defect (a fog) resembling scumming, which appears due to an accidental development of a slight amount of toner in a white portion (unexposed portion) where no printing is supposed to take place. There are also cases where it is desired to increase the bias current as close to the threshold current of a light emitting point as possible in order to improve the light beam output response in high-speed image forming.

SUMMARY OF THE INVENTION

The present invention provides a light scanning apparatus which supplies a variable amount of bias current to a light source.

According to one embodiment of the present invention, there is provided a light scanning apparatus, comprising:

a light source configured to emit a light beam;

a light intensity detection portion configured to detect a light intensity of the light beam; and a light intensity control portion configured to control the light intensity of the light beam based on a detection result of the light intensity detection portion, wherein the light intensity control portion supplies, in advance, to the light source, a bias current equal to or less than a threshold current at which the light source starts emitting the light beam, and supplies, to the light source, a switching current superposed on the bias current, the switching current being modulated in order to control light emission of the light source in accordance with an image signal, and wherein the light intensity control portion includes a bias current changing unit configured to change the bias current to be supplied to the light source.

Further features of the present invention will become apparent from the following description of exemplary embodiments with reference to the attached drawings.

DESCRIPTION OF THE EMBODIMENTS

Now, modes for carrying out the present invention will be described referring to the accompanying drawings.

[First Embodiment]

(Image Forming Apparatus)

Figure 10:
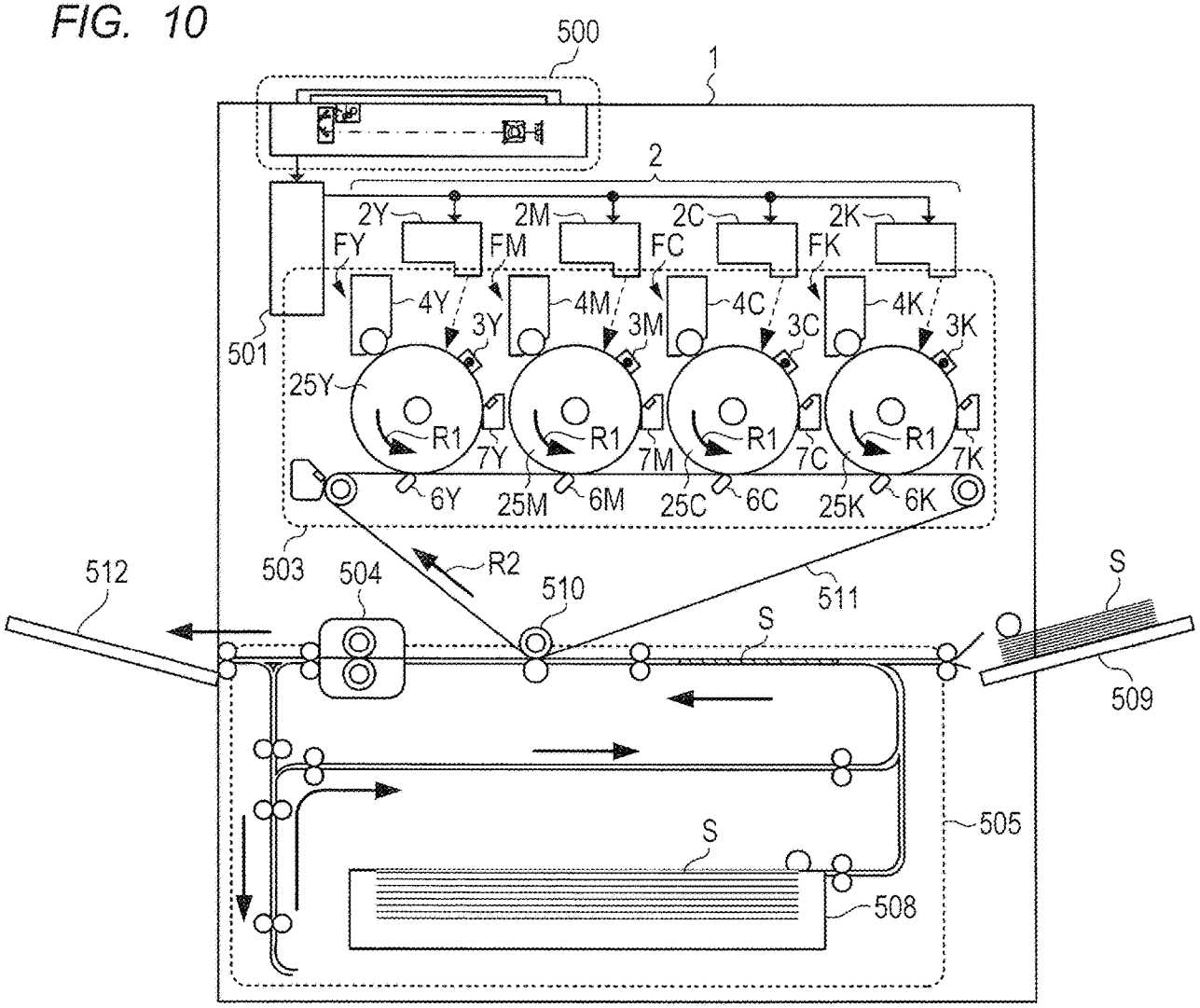
FIG. 10 is a sectional view of an image forming apparatus according to the first embodiment.

An electrophotographic image forming apparatus 1 according to a first embodiment will be described. FIG. 10 is a sectional view of the image forming apparatus 1 according to the first embodiment. The image forming apparatus 1 includes light scanning apparatus 2 (2Y, 2M, 2C, and 2K), an image control portion 501, an image reading portion 500, an image forming portion 503 having photosensitive drums (photosensitive members) 25, a fixing portion 504, and a sheet feeding and conveying portion 505. The image reading portion 500 is configured to illuminate an original placed on an original platen, optically read an image of the original, and convert the read image into image data (electric signal). The image control portion 501 is configured to receive the image data from the image reading portion 500 and convert the received image data into an image signal.

The image control portion 501 is further configured to transmit the image signal to each light scanning apparatus 2, and control the light emission of the light scanning apparatus 2.

The image forming portion 503 includes four image forming stations F (FY, FM, FC, and FK). The four image forming stations F are arranged in the order of yellow (Y), magenta (M), cyan (C), and black (K) along a rotation direction R2 of an endless intermediate transfer belt (hereinafter referred to as "intermediate transfer member") 511. The image forming stations F include photosensitive drums (photosensitive members) 25 (25Y, 25M, 25C, and 25K), respectively, serving as image bearing members rotated in a direction indicated by arrows R1. Around the photosensitive drums 25, there are arranged chargers (charging units) 3, the light scanning apparatus 2, developing devices (developing units) 4, primary transfer members 6 (6Y, 6M, 6C, and 6K), and cleaning devices 7 (7Y, 7M, 7C, and 7K), respectively, along the rotation direction indicated by the arrows R1.

The chargers 3 (3Y, 3M, 3C, and 3K) are configured to uniformly charge surfaces of the rotating photosensitive drums 25 (25Y, 25M, 25C, and 25K), respectively. The light scanning apparatus 2 (2Y, 2M, 2C, and 2K) are configured to emit light beams modulated in accordance with image signals, to thereby form electrostatic latent images on the surfaces of the photosensitive drums 25 (25Y, 25M, 25C, and 25K). The developing devices 4 (4Y, 4M, 4C, and 4K) are configured to develop the electrostatic latent images formed on the photosensitive drums 25 (25Y, 25M, 25C, and 25K) with toner (developer) of respective colors, to thereby form toner images. The primary transfer members 6 (6Y, 6M, 6C, and 6K) are configured to perform primary transfer of the toner images on the photosensitive drums 25 (25Y, 25M, 25C, and 25K) sequentially onto the intermediate transfer member 511 to superpose the images one on another. The cleaning devices 7 (7Y, 7M, 7C, and 7K) are configured to collect residual toner on the photosensitive drums 25 (25Y, 25M, 25C, and 25K) after the primary transfer.

The light scanning apparatus 2 (2Y, 2M, 2C, and 2K) are configured to sequentially start the emission of a light beam for a yellow image, a magenta image, a cyan image, and a black image after the light beam emitting start timing arrives for the yellow image. The emitting start timing of the light scanning apparatus 2 is controlled in a sub-scanning direction, to thereby transfer onto the intermediate transfer member 511 toner images of four colors that are superposed without color misregistration. A recording medium (hereinafter referred to as "sheet") S is conveyed from a sheet feeding cassette 508 of the sheet feeding and conveying portion 505 or from a manual feeding tray 509 to a secondary transfer roller 510. The secondary transfer roller 510 is configured to perform secondary transfer of collectively transferring the toner images on the intermediate transfer member 511 onto the sheet S. The sheet S having the toner images transferred thereon is conveyed to the fixing portion 504. The fixing portion 504 is configured to heat and press the sheet S to fuse the toner, to thereby fix the toner image onto the sheet S. With this, a full-color image is formed on the sheet S. The sheet S having the image formed thereon is delivered to a delivery tray 512.

(Light Scanning Apparatus)

Figure 1:
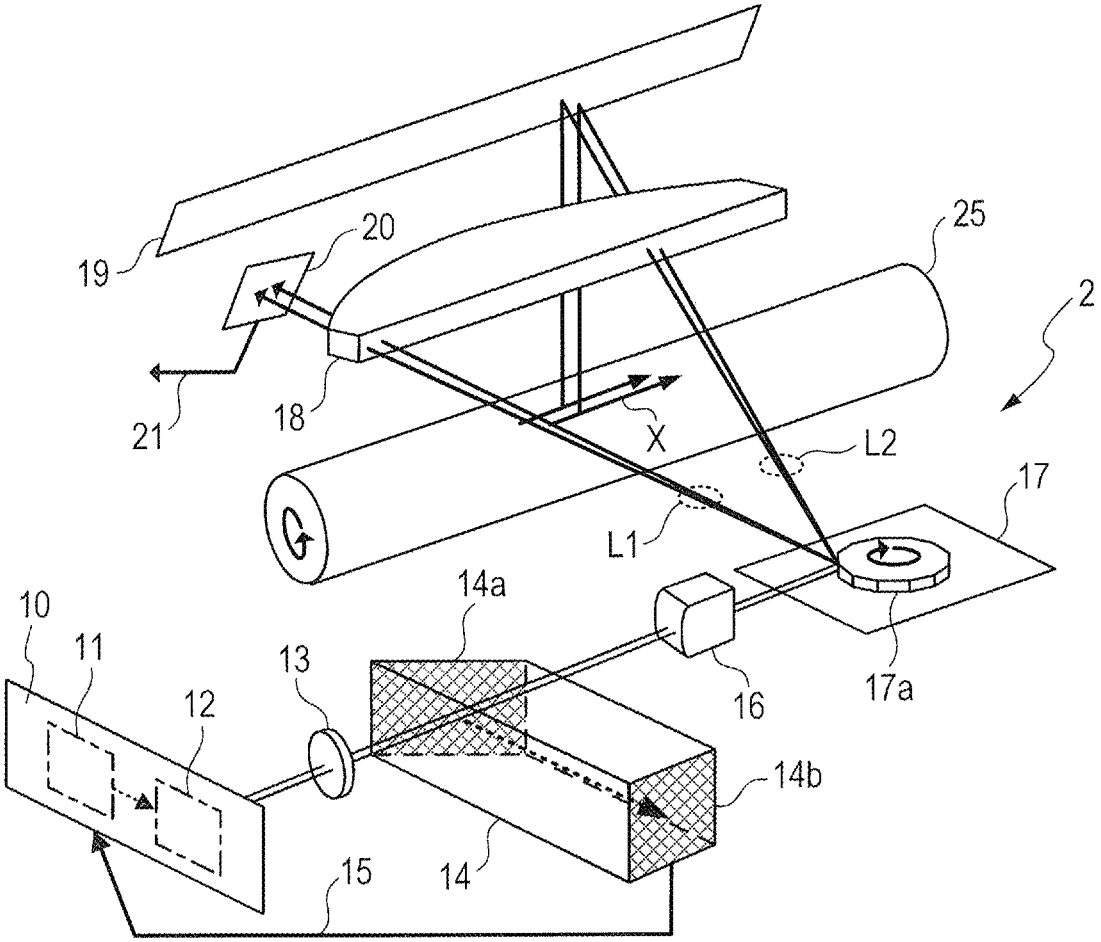
FIG. 1 is an explanatory view of a light scanning apparatus according to a first embodiment.

FIG. 1 is an explanatory view of the light scanning apparatus 2 according to the first embodiment. Each light scanning apparatus 2 includes a laser drive portion 11 and a laser diode (hereinafter abbreviated as "LD") 12, which serves as a light source. The laser drive portion 11 and the LD 12 are provided on a laser drive circuit board 10. The laser drive portion 11 is configured to output a drive current Idr for causing the LD 12 to emit light. The light scanning apparatus 2 further includes a collimator lens 13, a light intensity detecting unit 14, a cylindrical lens 16, a motor 17, an fθ lens 18, a reflection mirror 19, and a beam detector (hereinafter abbreviated as "BD") 20. A rotor of the motor 17 is configured to rotate integrally with a rotary polygon mirror 17*a*. In a non-image area, laser light (hereinafter referred to as "light beam") L1 emitted from the LD 12 reaches the rotary polygon mirror 17*a* after passing through the collimator lens 13 and the cylindrical lens 16. The light beam L1 is deflected by the rotary polygon mirror 17*a*. The light beam L1 deflected by the rotary polygon mirror 17*a* enters the BD 20 after passing through the fθ lens 18. The BD 20 receives the light beam L1 and then outputs a beam detection signal (hereinafter referred to as "BD signal") 21 for fixing the image writing start position in one place in a main scanning direction X. A light beam L2 modulated in accordance with image signals is emitted from the LD 12 based on the BD signal 21. The light beam L2 travels through the fθ lens 18, is reflected by the reflection mirror 19, and is run over the relevant photosensitive drum 25 in the main scanning direction X in an image area to form an electrostatic latent image. The LD 12 may emit a plurality of light beams. The rotary polygon mirror 17*a* and the motor 17 serve as a deflecting device configured to deflect the light beam L2 so that the light beam L2 emitted from the LD 12 is run over a surface of the photosensitive drum 25 in the main scanning direction X.

(Light Intensity Control Portion)

Figure 2:
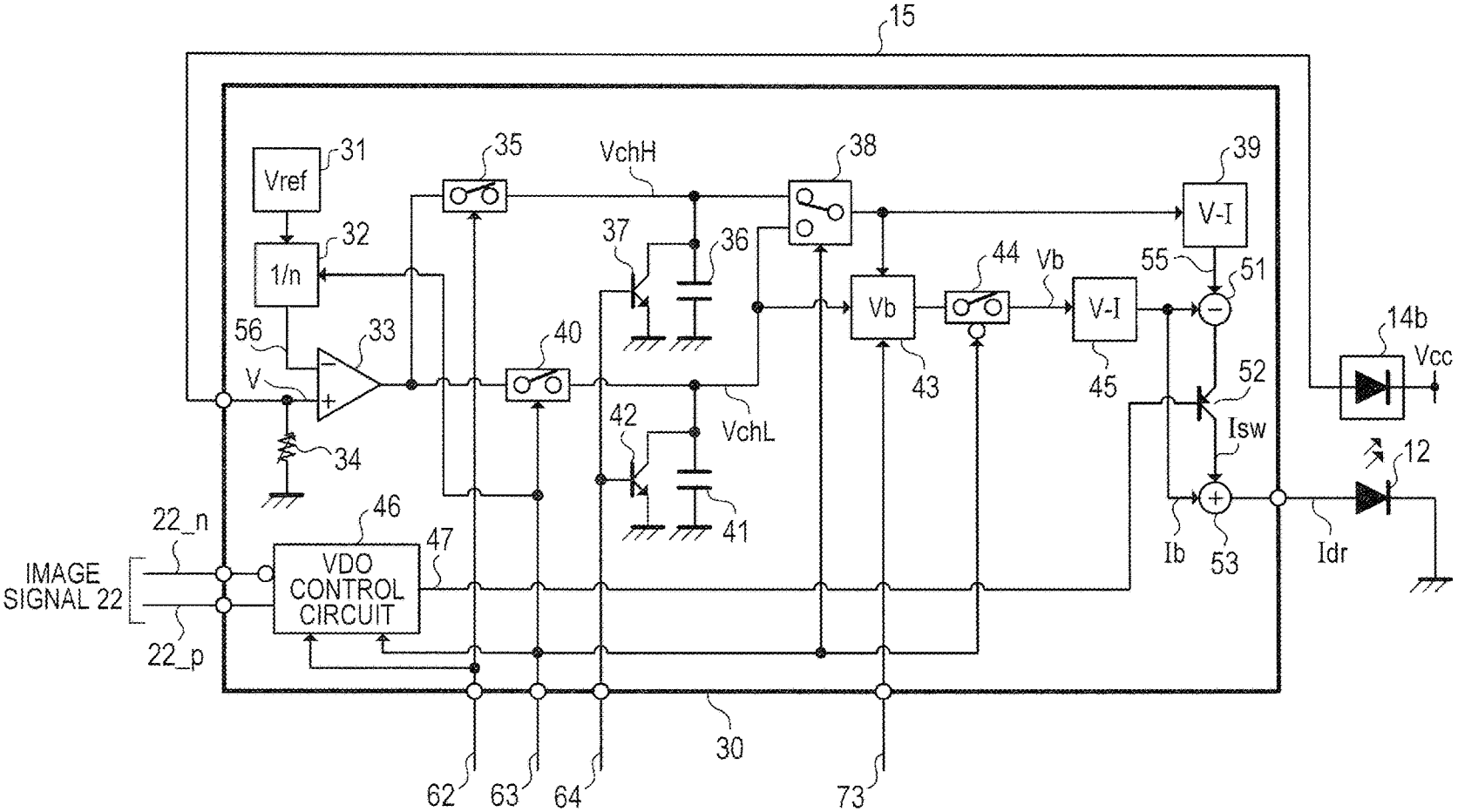
FIG. 2 is a block diagram of a light intensity control portion according to the first embodiment.

FIG. 2 is a block diagram of a light intensity control portion 30 according to the first embodiment. The light intensity control portion 30 is configured to determine the value of the driving current Idr, which is supplied to the LD 12 in order to emit a light beam of a given light intensity from the LD 12. The value of the drive current Idr is the sum of the value of a switching current Isw and the value of a standby current (hereinafter referred to as "bias current") Ib. The states of internal circuits of the light intensity control portion 30 in different operation modes are shown in Table 1.

TABLE 1

| Operation mode | Output voltage of voltage divider 32 | Upper side sample circuit 35 | Lower side sample circuit 40 | Diverter switch 38 | Switch 44 | VDO control circuit 47 | Discharge circuits 37 and 42 |
|---|---|---|---|---|---|---|---|
| Upper light intensity control | Vref × 1/1 | ON | OFF | Upper side | ON | ON | OFF |

TABLE 1-continued

| Operation mode | Output voltage of voltage divider 32 | Upper side sample circuit 35 | Lower side sample circuit 40 | Diverter switch 38 | Switch 44 | VDO control circuit 47 | Discharge circuits 37 and 42 |
|---|---|---|---|---|---|---|---|
| Lower light intensity control | Vref × 1/4 | OFF | ON | Lower side | OFF | ON | OFF |
| Constant-current control | — | OFF | OFF | Upper side | ON | ON/OFF | OFF |
| Initialization | — | OFF | OFF | Upper side | ON | OFF | ON |

The light intensity control portion 30 can operate in a plurality of operation modes, including an upper light intensity control mode (APC-H), a lower light intensity control mode (APC-L), a constant-current control mode, and an initialization mode. The selection of an operation mode from the plurality of operation modes of the light intensity control portion 30 is made with the use of a plurality of control signals output from the image control portion 501. An upper light intensity control signal 62, a lower light intensity control signal 63, a discharge signal 64, and a bias setting signal 73 are included among the plurality of control signals. In Table 1, there are shown states of the internal circuits of the light intensity control portion 30 in the upper light intensity control mode (APC-H), the lower light intensity control mode (APC-L), the constant-current control mode, and the initialization mode.

The light intensity control portion 30 is provided in the laser drive portion 11. The light intensity control portion 30 is configured to perform auto bias light intensity control in which a bias current Ib is calculated based on the light intensity of the LD 12. The LD 12 has a delayed light emission phenomenon. The delayed light emission phenomenon causes a drop in the light beam output response of the LD 12. In order to improve the light beam output response, the light intensity control portion 30 supplies the bias current Ib to the LD 12 in advance. The bias current Ib is set to a value smaller than a light emission start current (hereinafter referred to as "threshold current") Ith, at which the LD 12 starts laser oscillation. When the bias current Ib is supplied to the LD 12, the LD 12 does not emit a light beam (laser light), but casts faint light having as wide a wavelength range as that of an LED (LED light). The bias current Ib that is supplied to the LD 12 in the first embodiment is equal to or less than the threshold current Ith. However, the bias current Ib that has a larger value than the threshold current Ith may be supplied to the LD 12 in advance depending on image forming conditions.

The light intensity control portion 30 operates in the upper light intensity control mode and the lower light intensity control mode in order to calculate the bias current Ib. In the upper light intensity control mode, the light intensity control portion 30 obtains a high-level voltage VchH by causing the LD 12 to emit a light beam that has a first light intensity P1. In the lower light intensity control mode, the light intensity control portion 30 obtains a low-level voltage VchL by causing the LD 12 to emit a light beam that has a second light intensity P2, which is lower than the first light intensity P1. The light intensity control portion 30 calculates a threshold voltage Vth based on the high-level voltage VchH and the low-level voltage VchL. The light intensity control portion 30 obtains a bias voltage Vb, which is equal to or smaller than the threshold voltage Vth, and generates the bias current Ib based on the bias voltage Vb. The upper light intensity control mode, the lower light intensity control mode, a method of calculating the bias voltage Vb, and a method of generating the bias current Ib are described below.

(Upper Light Intensity Control Mode)

The upper light intensity control mode (APC-H), which is a first mode, will be described. In the upper light intensity control mode, the light intensity control portion 30 adjusts the value of the drive current Idr supplied to the LD 12 so that the LD 12 emits a light beam at the light intensity P1. The light intensity of a light beam emitted from the LD 12 is detected by a photodiode (hereinafter abbreviated as "PD") 14*b*, which serves as a light intensity detection portion (light receiving element). A voltage is applied to the PD 14*b* from a power source Vcc. The PD 14*b* is provided in the light intensity detecting unit 14 illustrated in FIG. 1. Part of a light beam emitted from the LD 12 is reflected by a half mirror 14*a* provided in the light intensity detecting unit 14, to thereby enter the PD 14*b*. The PD 14*b* receives the partial light beam and outputs a PD current 15 in an amount that is determined in relation to the intensity of the received light beam, as a light beam intensity detection result.

The PD current 15 is converted into a voltage V by a variable resistor 34. The voltage V of the PD current 15 is input to a comparator 33. The comparator 33 compares the voltage V of the PD current 15 and an output voltage 56 of a voltage divider 32. The voltage divider 32 divides a reference voltage Vref, which is generated by a reference voltage generating portion 31, at a predetermined ratio "n". In the upper light intensity control mode, the voltage divider 32 sets the ratio "n" to 1 (n=1), and outputs the output voltage 56 that is 1/1 of the reference voltage Vref (Vref× 1/1).

The output of the comparator 33 is input to an upper sampling circuit 35 and a lower sampling circuit 40. The upper sampling circuit 35 and a first capacitor 36 serve as a high-level voltage sample-and-hold circuit configured to sample and hold the high-level voltage (accumulation voltage) VchH. The lower sampling circuit 40 and a second capacitor 41 serve as a low-level voltage sample-and-hold circuit configured to sample and hold the low-level voltage (accumulation voltage) VchL. The upper sampling circuit 35 is controlled by the upper light intensity control signal 62 output from the image control portion 501. The lower sampling circuit 40 is controlled by the lower light intensity control signal 63 output from the image control portion 501. As shown in Table 1, the upper sampling circuit 35 is switched on by the upper light intensity control signal 62 and the lower sampling circuit 40 is switched off by the lower light intensity control signal 63 in the upper light intensity control mode. The upper sampling circuit 35 in the upper light intensity control mode therefore charges or discharges the first capacitor 36, depending on the output of the comparator 33.

Specifically, when the voltage V of the PD current 15 is smaller than the output voltage 56 of the voltage divider 32 (voltage V<reference voltage Vref), the intensity of a light beam of the LD 12 is lower than the first light intensity P1, and the upper sampling circuit 35 accordingly charges the first capacitor 36. When the voltage V of the PD current 15 is larger than the output voltage 56 of the voltage divider 32 (voltage V>reference voltage Vref), the intensity of a light beam of the LD 12 is higher than the first light intensity P1, and the upper sampling circuit 35 accordingly discharges the first capacitor 36. The first capacitor 36 samples the high-level voltage VchH in this manner.

The first capacitor 36 is connected to an upper terminal of a diverter switch (single pole double throw switch) 38. A lower terminal of the diverter switch 38 is connected to the second capacitor 41. A common terminal of the diverter switch 38 is connected to a bias voltage generating circuit 43 and a switching current generating circuit 39. In the upper light intensity control mode, the common terminal of the diverter switch 38 is connected to the upper terminal by the lower light intensity control signal 63 as shown in Table 1. The high-level voltage VchH of the first capacitor 36 is therefore applied to the switching current generating circuit 39 via the diverter switch 38. The switching current generating circuit 39 includes a voltage-current conversion circuit (V-I). The switching current generating circuit 39 converts the high-level voltage VchH of the first capacitor 36 into an output current 55.

In the upper light intensity control mode, the bias voltage generating circuit 43 is connected to a bias current generating circuit 45 via a switch (single pole single throw switch) 44. The bias current generating circuit 45 includes a voltage-current conversion circuit (V-I). The bias current generating circuit 45 is configured to generate the bias current Ib based on the bias voltage Vb, which is calculated by the bias voltage generating circuit 43. The bias current Ib is input to a subtracter 51 and an adder 53. The subtracter 51 subtracts the bias current Ib from the output current 55 of the switching current generating circuit 39 to generate a switching current Isw.

A video (VDO) control circuit 46, which is turned on in the upper light intensity control mode as shown in Table 1 by the upper light intensity control signal 62 and the lower light intensity control signal 63, outputs a video signal 47. The video signal 47 in the upper light intensity control mode is not a signal that is based on image signals 22 (a positive signal 22_*p* and a negative signal 22_*n*) transmitted in the form of a differential signal from the image control portion 501. The video signal 47 in the upper light intensity control mode is a signal that keeps a transistor 52 turned on based on the upper light intensity control signal 62. The adder 53 adds the bias current Ib to the switching current Isw to generate the drive current Idr, which is used to drive the LD 12.

In this manner, the light intensity control portion 30 in the upper light intensity control mode samples the high-level voltage VchH into the first capacitor 36 so that the light beam of the LD 12 has the first light intensity P1.

(Lower Light Intensity Control Mode)

The lower light intensity control mode (APC-L), which is a second mode, will be described. In the lower light intensity control mode, the light intensity control portion 30 adjusts the value of the drive current Idr that is supplied to the LD 12 so that the LD 12 emits a light beam that has the second light intensity P2, which is lower than the first light intensity P1. The PD 14*b* receives, via the half mirror 14*a*, part of a light beam emitted from the LD 12, and outputs the PD current 15 in an amount that is determined in relation to the intensity of the received light beam.

The PD current 15 is converted into the voltage V by the variable resistor 34. The voltage V of the PD current 15 is input to the comparator 33. The comparator 33 compares the voltage V of the PD current 15 and the output voltage 56 of the voltage divider 32. The voltage divider 32 divides the reference voltage Vref, which is generated by the reference voltage generating portion 31, at a ratio "n". In the lower light intensity control mode, the voltage divider 32 sets the ratio "n" to 4 (n=4), and outputs the output voltage 56 that is 1/4 of the reference voltage Vref (Vref×1/4).

The output of the comparator 33 is input to the upper sampling circuit 35 and the lower sampling circuit 40. As shown in Table 1, the upper sampling circuit 35 is switched off by the upper light intensity control signal 62 and the lower sampling circuit 40 is switched on by the lower light intensity control signal 63 in the lower light intensity control mode. The lower sampling circuit 40 in the lower light intensity control mode therefore charges or discharges the second capacitor 41, depending on the output of the comparator 33.

Specifically, when the voltage V of the PD current 15 is smaller than the output voltage 56 of the voltage divider 32 (voltage V<Vref×1/4), the intensity of a light beam of the LD 12 is lower than the second light intensity P2, and the lower sampling circuit 40 accordingly charges the second capacitor 41. When the voltage V of the PD current 15 is larger than the output voltage 56 of the voltage divider 32 (voltage V>Vref×1/4), the intensity of a light beam of the LD 12 is higher than the second light intensity P2, and the lower sampling circuit 40 accordingly discharges the second capacitor 41. The second capacitor 41 samples the low-level voltage VchL in this manner.

The second capacitor 41 is connected to the lower terminal of the diverter switch 38 and to the bias voltage generating circuit 43. The bias voltage generating circuit 43 is connected to the common terminal of the diverter switch 38 and to the switch 44 as well. In the lower light intensity control mode, the common terminal of the diverter switch 38 is connected to the lower terminal by the lower light intensity control signal 63 as shown in Table 1. The low-level voltage VchL of the second capacitor 41 is therefore applied to the switching current generating circuit 39 via the diverter switch 38. The switching current generating circuit 39 converts the low-level voltage VchL of the second capacitor 41 into the output current 55.

In the lower light intensity control mode where the switch 44 is switched off as shown in Table 1 by the lower light intensity control signal 63, the bias current generating circuit 45 does not generate the bias current Ib. Consequently, no bias current Ib is supplied to the subtracter 51 and the adder 53, which therefore do not perform the addition and subtraction of the bias current Ib to and from the output current 55 of the switching current generating circuit 39 in the lower light intensity control mode.

The VDO control circuit 46, which is turned on in the lower light intensity control mode as shown in Table 1 by the upper light intensity control signal 62 and the lower light intensity control signal 63, outputs the video signal 47. The video signal 47 in the lower light intensity control mode is not a signal that is based on the image signals 22 (the positive signal 22_*p* and the negative signal 22_*n*) transmitted in the form of a differential signal from the image control portion 501. The video signal 47 in the lower light intensity control mode is a signal that keeps a transistor 52 turned on based on the lower light intensity control signal 63. With the subtracter 51 and the adder 53 not performing the addition and subtraction of the bias current Ib to and from the output current 55 of the switching current generating circuit 39, the output current 55 of the switching current generating circuit 39 is supplied as the drive current Idr to the LD 12.

In this manner, the light intensity control portion 30 in the lower light intensity control mode samples the low-level voltage VchL into the second capacitor 41 so that the light beam of the LD 12 has the second light intensity P2.

(Bias Current Changing Method)

Figure 3:
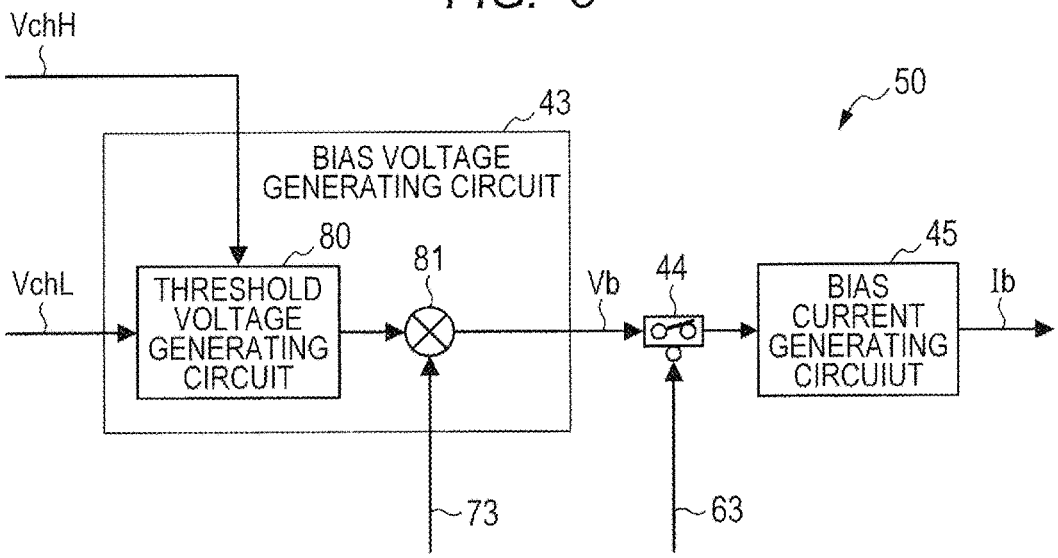
FIG. 3 is a block diagram of a bias current changing unit according to the first embodiment.
Figure 4:
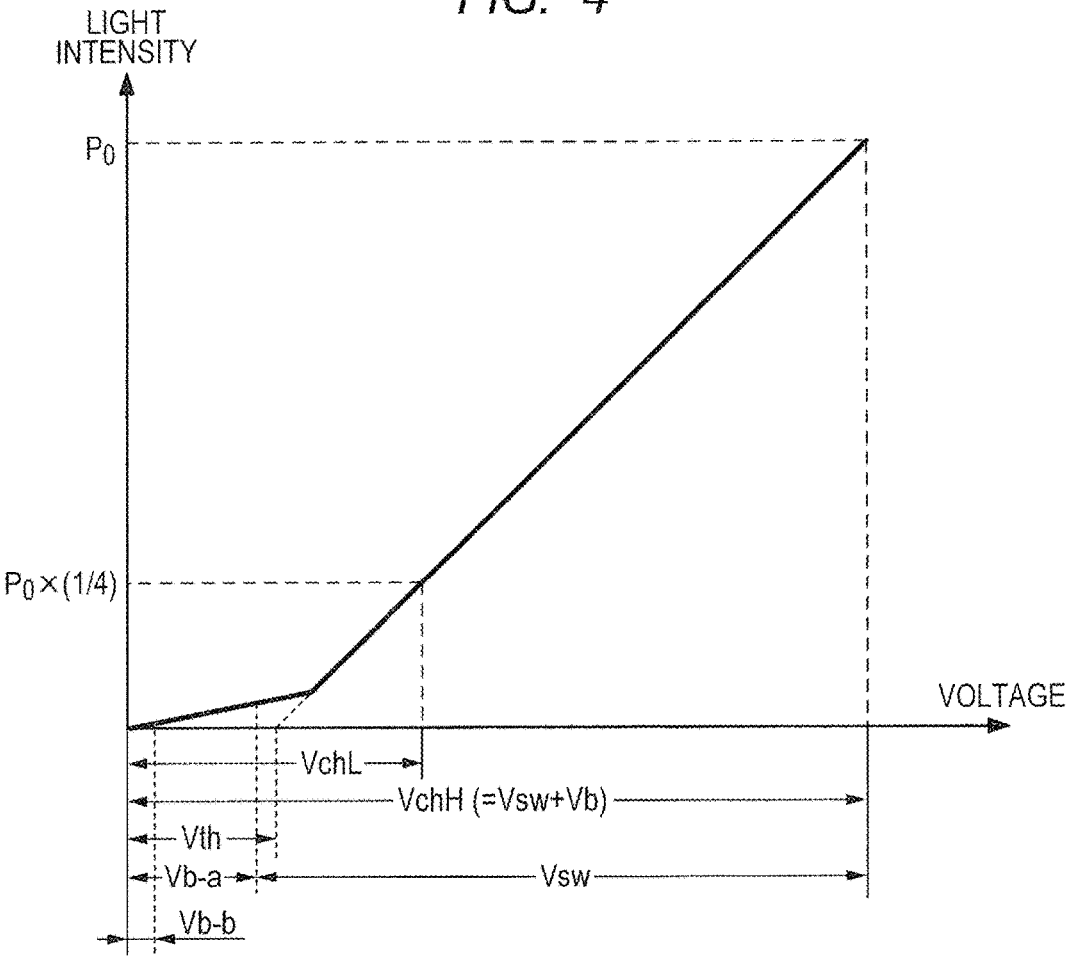
FIG. 4 is a graph for showing a relation between the voltage of a capacitor and the light intensity of a light beam.

A method of changing the bias current Ib will be described below with reference to FIG. 3 and FIG. 4. FIG. 3 is a block diagram of a bias current changing unit 50 according to the first embodiment. FIG. 4 is a graph for showing the relation between the voltage of a capacitor and the light intensity of a light beam. The bias current changing unit 50 includes the bias voltage generating circuit 43, which serves as a bias voltage calculating unit, and the bias current generating circuit 45. The bias voltage generating circuit 43 includes a threshold voltage generating circuit 80, which serves as a threshold voltage calculating unit, and a multiplier (voltage amplifier) 81, which serves as a bias voltage changing unit. The threshold voltage generating circuit 80 is electrically connected to the first capacitor 36 via the diverter switch 38, and the high-level voltage VchH is applied to the threshold voltage generating circuit 80 from the first capacitor 36. The threshold voltage generating circuit 80 is also electrically connected to the second capacitor 41, and the low-level voltage VchL is applied to the threshold voltage generating circuit 80 from the second capacitor 41.

A target light intensity $P_0$ shown in FIG. 4 is a light intensity at which the surface of the photosensitive drum 25 is exposed when an image is formed. The target light intensity $P_0$ corresponds to the first light intensity P1 of a light beam that is emitted by the LD 12 in the upper light intensity control mode. In the case where the first capacitor 36 is charged to the high-level voltage VchH in the upper light intensity control mode, the light intensity of the light beam is the first light intensity P1, namely, the target light intensity $P_0$. The target light intensity $P_0 \times 1/4$ corresponds to the second light intensity P2 of a light beam that is emitted by the LD 12 in the lower light intensity control mode. In the case where the second capacitor 41 is charged to the low-level voltage VchL in the lower light intensity control mode, the light intensity of the light beam is the second light intensity P2, namely, the target light intensity $P_0 \times 1/4$.

The second light intensity P2 in the first embodiment is set to a quarter of the first light intensity P1. However, the first embodiment is not limited thereto. The second light intensity P2 can be set to any value, for example, a third or a fifth of the first light intensity P1. A preferred value of the second light intensity P2 is higher than that of a light intensity that corresponds to the threshold voltage Vth.

The threshold voltage (light emission start voltage) Vth at which the LD 12 starts laser oscillation is calculated when an image is formed in the constant-current control mode described later. The threshold voltage generating circuit 80 generates the threshold voltage Vth from the high-level voltage VchH, which is held by the first capacitor 36, and the low-level voltage VchL, which is held by the second capacitor 41, through Expression (1).

$$(VchH-Vth):(VchL-Vth)=P_0:1/4P_0 \therefore Vth=(4VchL-VchH)/3 \quad \text{Expression (1)}$$

The multiplier 81, which serves as the voltage amplifier, generates the bias voltage Vb (Vb−a or Vb−b) through Expression (2) or (3) based on an arbitrary coefficient α or β, which is set in accordance with the bias setting signal 73.

$$Vb-a=\alpha \times Vth(\alpha \leq 1) \quad \text{Expression (2)}$$

$$Vb-b=\beta \times Vth(0 \leq \beta < 1, 0 \leq \beta << \alpha) \quad \text{Expression (3)}$$

In the case of preventing a fog or improving output response for high-speed image forming, for example, the bias voltage Vb−a may be generated with the coefficient α set to 1 (α=1). In the case where the LD 12 is not used, the bias voltage Vb−b may be generated with the coefficient β set to 0 (β=0). The coefficient α or β is set in accordance with the bias setting signal 73 output from the image control portion 501. The image control portion 501 sets the coefficient α or β based on whether or not the LD 12 is used and on the temperature or humidity of the image forming apparatus 1 or other environmental conditions, and generates the bias setting signal 73.

The bias voltage generating circuit 43 inputs the bias voltage Vb (Vb−a or Vb−b) to the bias current generating circuit 45 via the switch 44. The bias current generating circuit 45 having a voltage-current conversion circuit converts the bias voltage Vb into the bias current Ib. The bias current generating circuit 45 supplies the bias current Ib to the LD 12. According to the first embodiment, the bias current Ib can be supplied to the LD 12 in a variable amount that is varied depending on image forming conditions.

(Constant-Current Control Mode)

The constant-current control mode, which is a light writing mode for forming a latent image by running a light beam over the surface of the photosensitive drum 25, will be described. The light intensity control portion 30 operates in the constant-current control mode in order to drive the LD 12 in accordance with the image signals 22 (the positive signal 22_*p* and the negative signal 22_*n*), which are transmitted in the form of a differential signal from the image control portion 501 when an image is formed. In the constant-current control mode, the upper sampling circuit 35 is switched off as shown in Table 1 by the upper light intensity control signal 62. This causes the first capacitor 36 to hold the high-level voltage VchH. The lower sampling circuit 40 is switched off by the lower light intensity control signal 63. This causes the second capacitor 41 to hold the low-level voltage VchL.

The diverter switch 38 connects the first capacitor 36 to the bias voltage generating circuit 43 and the switching current generating circuit 39. The high-level voltage VchH of the first capacitor 36 is applied to the bias voltage generating circuit 43. The bias voltage generating circuit 43 generates the bias voltage Vb based on the high-level voltage VchH of the first capacitor 36 and the low-level voltage VchL of the second capacitor 41. The bias voltage Vb is input to the bias current generating circuit 45 via the switch 44. The bias current generating circuit 45 converts the bias voltage Vb into the bias current Ib. The bias current Ib is supplied to the subtracter 51 and the adder 53.

The high-level voltage VchH of the first capacitor 36 is also applied to the switching current generating circuit 39 via the diverter switch 38. The switching current generating circuit 39 converts the high-level voltage VchH into the output current 55. The output current 55 is input to the subtracter 51. The subtracter 51 subtracts the bias current Ib from the output current 55 to generate the switching current Isw. The switching current Isw is input to the transistor 52.

The image signal 22 (the positive signal 22_*p* and the negative signal 22_*n*) transmitted in the form of a differential signal from the image control portion 501 is input to the VDO control circuit 46. The VDO control circuit 46 generates the video signal 47 based on the upper light intensity control signal 62 and the lower light intensity control signal 63. The video signal 47 is input to the transistor 52. The video signal 47 in the constant-current control mode is a modulation signal that turns the transistor 52 on or off depending on the image signal 22. The transistor 52 modulates the switching current Isw in accordance with the video signal 47. The adder 53 adds the bias current Ib to the modulated switching current Isw to generate the drive current Idr. The drive current Idr is supplied to the LD 12. The drive current Idr is a current in which the bias current Ib is superposed on the modulated switching current Isw. The bias current Ib is therefore supplied to the LD 12 when an image is formed. The switching current Isw modulated in accordance with the image signal 22 is supplied to the LD 12 in order to emit a light beam to the photosensitive drum 25 at a target light intensity. Through supplying of the bias current Ib to the LD 12 when an image is formed, the light emission response of the LD 12 when the switching current Isw is supplied is enhanced as compared to a case where the bias current Ib is not supplied.

(Initialization Mode)

The initialization mode will be described. The light intensity control portion 30 operates in the initialization mode immediately after the image forming apparatus 1 is powered on or when the light scanning apparatus 2 is stopped. The image control portion 501 outputs the upper light intensity control signal 62 and the lower light intensity control signal 63 to turn the upper sampling circuit 35 and the lower sampling circuit 40 off, and outputs the discharge signal 64 to turn discharge circuits 37 and 42 on. The discharge circuits 37 and 42 forcibly discharge the first capacitor 36 and the second capacitor 41. As a result, the voltages applied to the switching current generating circuit 39 and the bias current generating circuit 45 becomes 0 (zero), and thus no drive current Idr is supplied to the LD 12.

According to the first embodiment, the bias current changing unit 50 can change the bias current Ib based on the coefficient α or β, which is set in accordance with the bias setting signal 73 output from the image control portion 501. The bias current changing unit 50 can therefore supply the bias current Ib to the LD 12 in a variable amount that is varied depending on image forming conditions, which include light emission conditions of the LD 12 and environmental conditions.

[Modification Example of First Embodiment]

Figure 5:
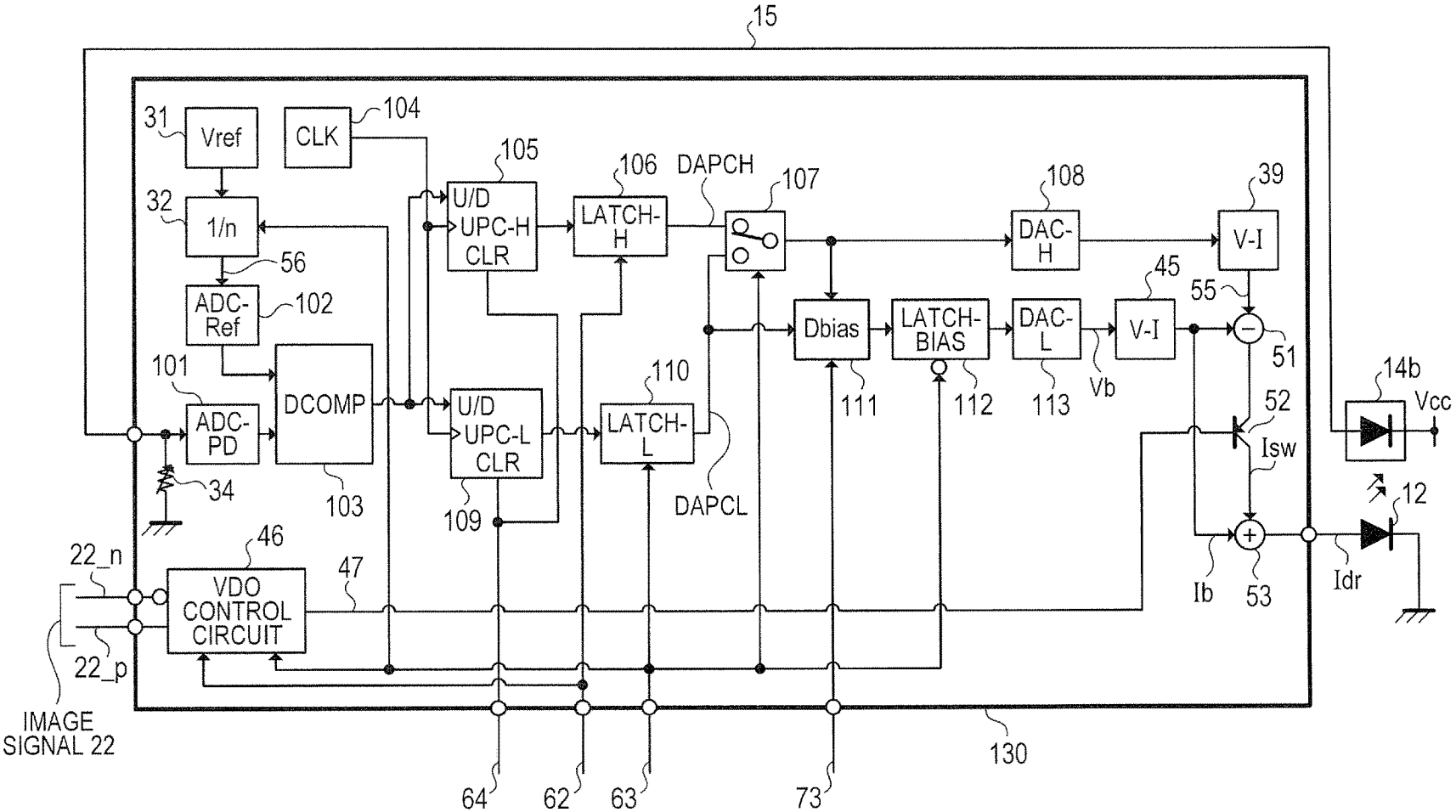
FIG. 5 is a block diagram of a light intensity control portion according to a modification example of the first embodiment.

A modification example of the first embodiment will be described. FIG. 5 is a block diagram of a light intensity control portion 130 according to the modification example of the first embodiment. The light intensity control portion 130 is made up of digital circuits. In the light intensity control portion 130 illustrated in FIG. 5, the same structures as those of the light intensity control portion 30 illustrated in FIG. 2 are denoted by the same reference symbols, and descriptions thereof are omitted.

The association relation between the structures of the light intensity control portion 30 illustrated in FIG. 2 and the structures of the light intensity control portion 130 illustrated in FIG. 5 is shown in Table 2.

TABLE 2

| Light intensity control portion 30 of FIG. 2 | | Light intensity control portion 130 of FIG. 5 | |
|---|---|---|---|
| First condenser 36 | charge/discharge | First counter 105 | up/down |
| Second condenser 41 | charge/discharge | Second counter 109 | up/down |
| Upper side sample circuit 35 | ON/OFF | First latch 106 | through/latch |
| Lower side sample circuit 40 | ON/OFF | Second latch 110 | through/latch |
| Switch 44 | ON/OFF | Bias latch 112 | through/latch |

(Upper Light Intensity Control Mode)

In the upper light intensity control mode, the light intensity controller 130 adjusts the value of the drive current Idr that is supplied to the LD 12 so that the LD 12 emits a light beam having the first light intensity P1. The intensity of the light beam emitted from the LD 12 is detected by the PD 14*b*. The PD 14*b* receives the light beam and outputs the PD current 15 in an amount that is determined in relation to the intensity of the received light beam. The PD current 15 is converted into the voltage V by the variable resistor 34. The voltage V is converted into a digital value ADC-PD by an analog-to-digital converter 101. The digital value ADC-PD is input to a digital comparator (DCOMP) 103.

The voltage divider 32 divides the reference voltage Vref generated by the reference voltage generating circuit 31 at the ratio "n". In the upper light intensity control mode, the voltage divider 32 sets the ratio "n" to 1 (n=1), and outputs the output voltage 56 that is 1/1 of the reference voltage Vref (Vref×1/1). The output voltage 56 of the voltage divider 32 is converted into a digital value ADC-Ref by an analog-to-digital converter 102. The digital value ADC-Ref is input to the digital comparator 103.

The digital comparator (DCOMP) 103 compares the digital value ADC-PD of the analog-to-digital converter 101 and the digital value ADC-Ref of the analog-to-digital converter 102 to generate an up signal or a down signal. Specifically, when the digital value ADC-PD is smaller than the digital value ADC-Ref (ADC-PD<ADC-Ref), the light beam of the LD 12 has an intensity lower than the first light intensity P1, and the digital comparator 103 accordingly outputs an up signal. The up signal is input to a first up/down counter (hereinafter referred to as "first counter") 105, which then increases its count. This corresponds to charging the first capacitor 36 of the light intensity control portion 30 of FIG. 2. When the digital value ADC-PD is larger than the digital value ADC-Ref (ADC-PD>ADC-Ref), the light beam of the LD 12 has an intensity higher than the first light intensity P1, and the digital comparator 103 accordingly outputs a down signal. The down signal is input to the first counter 105, which then decreases its count. This corresponds to discharging the first capacitor 36 of the light intensity control portion 30 of FIG. 2. The first counter 105 samples a high-level count DAPCH in this manner.

(Lower Light Intensity Control Mode)

In the lower light intensity control mode, the light intensity control portion 130 adjusts the value of the drive current Idr that is supplied to the LD 12 so that the LD 12 emits a light beam having the second light intensity P2 that is smaller than the first light intensity P1. The PD 14*b* receives the light beam and outputs the PD current 15 in an amount that is determined in relation to the intensity of the received light beam. The PD current 15 is converted into the voltage V by the variable resistor 34. The voltage V is converted into the digital value ADC-PD by the analog-to-digital converter 101. The digital value ADC-PD is input to the digital comparator 103.

The voltage divider 32 sets the ratio "n" to 4 (n=4), and outputs the output voltage 56 that is 1/4 of the reference voltage Vref (Vref×1/4). The output voltage 56 of the voltage divider 32 is converted into the digital value ADC-Ref by the analog-to-digital converter 102. The digital value ADC-Ref is input to the digital comparator 103.

The digital comparator 103 compares the digital value ADC-PD of the analog-to-digital converter 101 and the digital value ADC-Ref of the analog-to-digital converter 102 to generate an up signal or a down signal. The up signal or the down signal is input to a second up/down counter (hereinafter referred to as "second counter") 109. The second counter 109 samples a low-level count DAPCL in the same manner as in the upper light intensity control mode.

A first latch 106 latches the high-level count DAPCH of the first counter 105 in response to the upper light intensity control signal 62. The high-level count DAPCH is input to a first digital-to-analog converter (DAC-H) 108 and a bias data generating circuit (Dbias) 111 via a diverter switch 107. A second latch 110 latches the low-level count DAPCL of the second counter 109 in response to the lower light intensity control signal 63. The low-level count DAPCL is input to the bias data generating circuit 111.

(Bias Current Changing Method)

Figure 6:
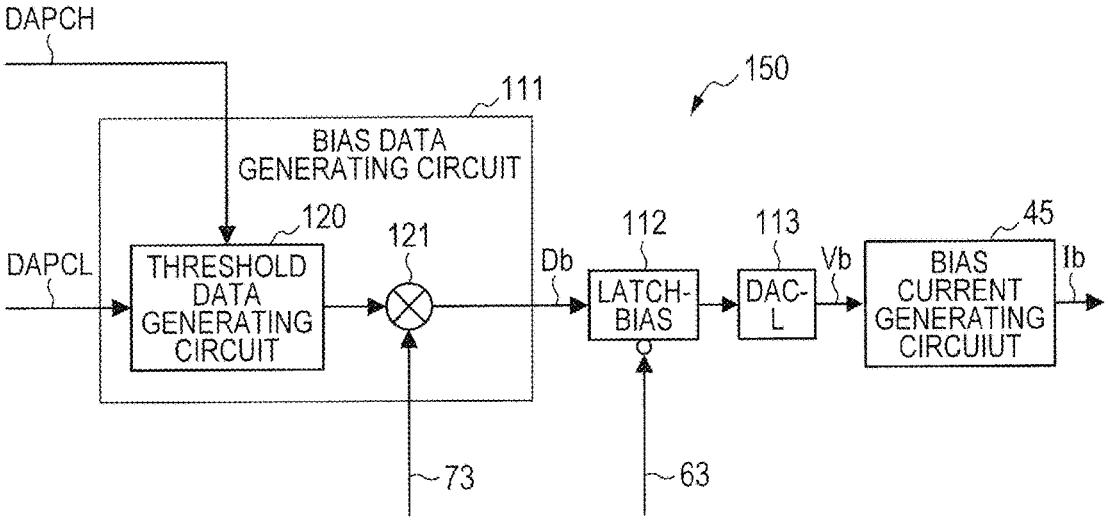
FIG. 6 is a block diagram of a bias current changing unit according to the modification example of the first embodiment.

A method of changing the bias current Ib will be described below with reference to FIG. 6. FIG. 6 is a block diagram of a bias current changing unit 150 according to the modification example of the first embodiment. The bias current changing unit 150 includes the bias data generating circuit 111, which serves as a bias voltage calculating unit, and the bias current generating circuit 45. The bias data generating circuit 111 includes a threshold data generating circuit 120, which serves as a threshold voltage calculating unit, and a multiplier 121, which serves as a bias voltage changing unit. The threshold data generating circuit 120 is electrically connected to the first latch 106 via the diverter switch 107, and the high-level count DAPCH is input to the threshold data generating circuit 120 from the first latch 106. The threshold data generating circuit 120 is also electrically connected to the second latch 110, and the low-level count DAPCL is input to the threshold data generating circuit 120 from the second latch 110.

The bias data generating circuit 111 calculates threshold data Dth from the high-level count DAPCH of the first latch 106 and the low-level count DAPCL of the second latch 110 through Expression (4).

$$(DAPCH-Dth):(DAPCL-Dth)=P_0:1/4P_0 \therefore Dth=(4DAPCL-DAPCH)/3 \quad \text{Expression (4)}$$

The multiplier 121 generates bias data Db (Db-a or Db-b) through Expression (5) or (6) based on an arbitrary coefficient α or β, which is set in accordance with the bias setting signal 73.

$$Db-a=\alpha\times Dth(\alpha\leq 1) \quad \text{Expression (5)}$$

$$Db-b=\beta\times Dth(0\leq\beta<1, 0\leq\beta<<\alpha) \quad \text{Expression (6)}$$

The high-level count DAPCH of the first latch 106 corresponds to the high-level voltage VchH, and the low-level count DAPCL of the second latch 110 corresponds to the low-level voltage VchL. The threshold data Dth corresponds to the threshold voltage Vth, and the bias data Db corresponds to the bias voltage Vb. The relation between the light intensity and a count is the same as the relation between the light intensity and the voltage which is shown in FIG. 4.

In the case of preventing a fog or improving output response for high-speed image forming, for example, the bias data Db−a may be generated with the coefficient α set to 1 (α=1). In the case where the LD 12 is not used, the bias data Db−b may be generated with the coefficient β set to 0 (β=0). The coefficient α or β is set in accordance with the bias setting signal 73 output from the image control portion 501. The image control portion 501 sets the coefficient α or β based on whether or not the LD 12 is used and on the temperature or humidity of the image forming apparatus 1 or other environmental conditions, and generates the bias setting signal 73.

The bias data generating circuit 111 outputs the bias data Db (Db−a or Db−b) to a second digital-to-analog converter (DAC-L) 113 via a bias latch (LATCH-BIAS) 112. The second digital-to-analog converter 113 converts the bias data Db into the bias voltage Vb. The second digital-to-analog converter 113 inputs the bias voltage Vb to the bias current generating circuit 45. The bias current generating circuit 45 having a voltage-current conversion circuit converts the bias voltage Vb into the bias current Ib. The bias current generating circuit 45 supplies the bias current Ib to the LD 12. According to the modification example of the first embodiment, the bias current Ib can be supplied to the LD 12 in a variable amount that is varied depending on image forming conditions.

(Constant-Current Control Mode)

The light intensity control portion 130 in the constant-current control mode operates substantially the same way as the light intensity control portion 30 of FIG. 2 does in the constant-current control mode. The diverter switch 107 connects the first latch 106 to the bias data generating circuit 111 and the first digital-to-analog converter 108. The first digital-to-analog converter 108 converts the high-level count DAPCH of the first latch 106 into an analog voltage. The analog voltage of the first digital-to-analog converter 108 is applied to the switching current generating circuit 39. The bias voltage Vb of the second digital-to-analog converter 113 is input to the bias current generating circuit 45. The subsequent operation is substantially the same as the operation of the light intensity control portion 30, and therefore a description thereof is omitted.

(Initialization Mode)

The discharge circuit 37 and the discharge circuit 42 of FIG. 2 correspond to a clear function (CLR) of the first counter 105 and a clear function (CLR) of the second counter 109, respectively. The first counter 105 clears the count of the first counter 105 to 0 (zero) in response to the discharge signal 64. The second counter 109 clears the count of the second counter 109 to 0 (zero) in response to the discharge signal 64. As a result, the voltages applied to the switching current generating circuit 39 and the bias current generating circuit 45 becomes 0 (zero), and thus no drive current Idr is supplied to the LD 12.

According to the modification example of the first embodiment, the bias current changing unit 150 can change the bias current Ib based on the coefficient α or β, which is set in accordance with the bias setting signal 73 output from the image control portion 501. The bias current changing unit 150 can therefore supply the bias current Ib to the LD 12 in a variable amount that is varied depending on image forming conditions, which include light emission conditions of the LD 12 and environmental conditions. According to the modification example of the first embodiment, a variable amount of bias current can be supplied to a light source.

[Second Embodiment]

Next, a second embodiment will be described. In the second embodiment, the same structures as those of the first embodiment are denoted by the same reference symbols, and descriptions thereof are omitted. The image forming apparatus 1 and the light scanning apparatus 2 according to the second embodiment are the same as those of the first embodiment, and hence descriptions thereof are omitted. A laser drive portion 211 of the second embodiment differs from the laser drive portion 11 of the first embodiment. The following description focuses on the laser drive portion 211 of the second embodiment.

(Laser Drive Portion)

Figure 7:
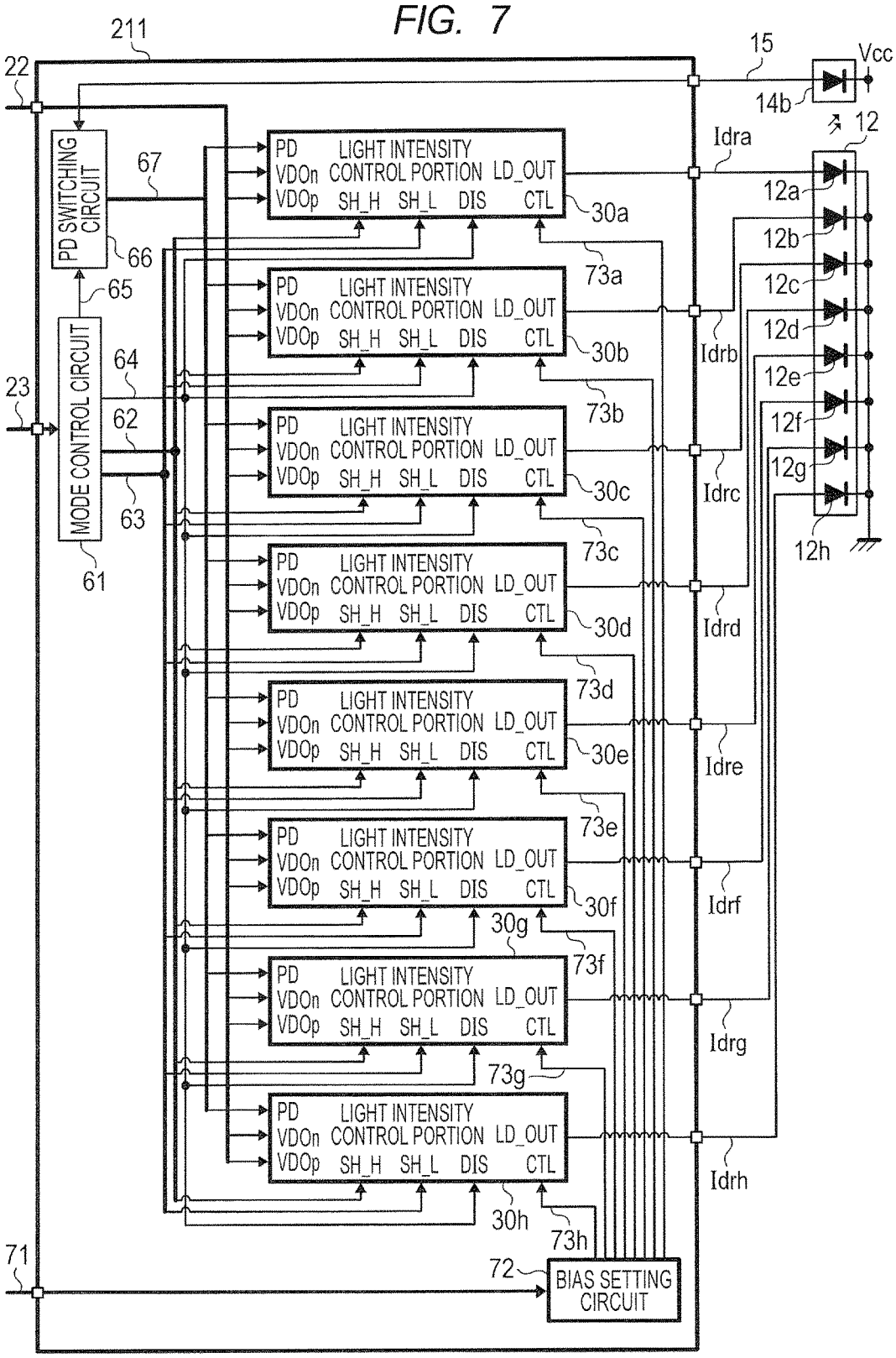
FIG. 7 is a block diagram of a laser drive portion according to a second embodiment.

FIG. 7 is a block diagram of the laser drive portion 211 according to the second embodiment. The laser drive portion 211 is provided on the laser drive circuit board 10 of each light scanning apparatus 2. The laser drive portion 211 includes a plurality of light intensity control portions 30, a mode control circuit 61, a PD switching circuit 66, and a bias setting circuit 72. The LD 12 in the second embodiment emits eight light beams, and has eight light emitting points 12*a*, 12*b*, 12*c*, 12*d*, 12*e*, 12*f*, 12*g*, and 12*h*. The LD 12 may instead be configured to have as many light emitting points as needed to emit nine or more light beams, or seven or less light beams. A preferred LD 12 is, for example, a vertical cavity surface emitting laser (VCSEL).

The laser drive portion 211 has as many light intensity control portions 30 as the number of the light emitting points 12*a* to 12*h* of the LD 12 (here, 30*a*, 30*b*, 30*c*, 30*d*, 30*e*, 30*f*, 30*g*, and 30*h*). Specifically, eight light intensity control portions 30*a*, 30*b*, 30*c*, 30*d*, 30*e*, 30*f*, 30*g*, and 30*h* are connected to eight light emitting points 12*a*, 12*b*, 12*c*, 12*d*, 12*e*, 12*f*, 12*g*, and 12*h*, respectively. The light intensity control portions 30 (30*a* to 30*h*) are the same as the light intensity control portion 30 of the first embodiment which is illustrated in FIG. 2, and therefore a description thereof is omitted. The light intensity control portions 30 (30*a* to 30*h*) may instead be the same as the light intensity control portion 130 according to the modification example of the first embodiment.

The mode control circuit 61 is configured to generate upper light intensity control signals 62 (62*a* to 62*h*), lower light intensity control signals 63 (63*a* to 63*h*), and the discharge signal 64 based on a laser control signal 23, which is input from the image control portion 501. The upper light intensity control signals 62 (62*a* to 62*h*), the lower light intensity control signals 63 (63*a* to 63*h*), and the discharge signal 64 are input to the corresponding light intensity control portions 30 (30*a* to 30*h*) via a bus. The mode control circuit 61 is also configured to output a PD switching signal 65 to the PD switching circuit 66. The PD switching circuit 66 is configured to receive the PD current 15 from the PD 14*b*, which receives light beams output from the light emitting points 12*a* to 12*h*, respectively, and to output the PD current 15 selectively to the corresponding light intensity control portions 30 (30*a* to 30*h*) via a bus 67 based on the PD switching signal 65.

The bias setting circuit 72, which serves as a bias current setting unit, is configured to generate bias setting signals 73 (73*a* to 73*h*) based on a bias control signal 71, which is input from the image control portion 501. The bias control signal 71 is a serial signal output from the image control portion 501. The bias control signal 71 may instead be a parallel signal output from the image control portion 501. The bias setting circuit 72 determines the coefficient α or β of the bias voltage Vb for each of the light intensity control portions 30 (30*a* to 30*h*) based on the bias control signal 71, and generates the bias setting signals 73 (73*a* to 73*h*). The light intensity control portions 30 (30*a* to 30*h*) variably control bias currents Ib (Iba to Ibh) of driving currents Idr (Idra to Idrh), which are supplied to the light emitting points 12*a* to 12H of the LD 12, respectively, based on the bias setting signals 73 (73*a* to 73*h*).

According to the second embodiment, the bias setting circuit 72, which serves as a bias current setting unit, determines the coefficient α or β for each of the plurality of light emitting points 12*a* to 12*h* based on the bias control signal 71, which is output from the image control portion 501, and generates the bias setting signals 73 (73*a* to 73*h*). The plurality of light intensity control portions 30*a* to 30*h* can change the bias currents Iba to Ibh based on the bias setting signals 73*a* to 73*h*, respectively. This enables the bias setting circuit 72 to supply the bias current Ib to the plurality of light emitting points 12*a* to 12*h* independently of one another in a variable amount that is varied depending on image forming conditions, which include the light emission conditions of the plurality of light emitting points 12*a* to 12*h* and environmental conditions.

For example, in the case where the sheet S is switched from plain paper to thick paper, fixing a toner image to thick paper requires a large amount of heat and the process speed is therefore lowered. In this case, the number of light beams output from the LD 12 is reduced to a number suited to the lowered process speed. For example, in the case of reducing the number of light beams that are output from the LD 12 from eight to six to accommodate a drop in process speed, the bias control signal 71 that instructs a reduction in light beam count from eight to six is input to the bias setting circuit 72. The image control portion 501 inputs to the bias setting circuit 72 the bias control signal 71 that instructs a change in the number of light beams output from the LD 12 also when the resolution of an image is changed.

Based on the bias control signal 71, the bias setting circuit 72 sets the coefficient α of the bias voltage Vb to 1 or a value smaller than 1 for a light emitting point that is allowed to emit light, and sets the coefficient β of the bias voltage Vb to 0 or a value larger than 0 for a light emitting point that is prohibited from emitting light. The bias setting circuit 72 generates the bias setting signals 73 (73*a* to 73*h*) based on the coefficient α or β that is set for each light intensity control portion 30 separately, and outputs the generated signals to the respective light intensity control portions 30. The coefficient β is set to a value far smaller than the coefficient α. This gives a value 0 (zero) or a small value close to 0 (zero) to the bias current Ib that is supplied to a light emitting point prohibited from emitting light, with the result that power consumption is reduced in the relevant light intensity control portion 30.

Figure 8:
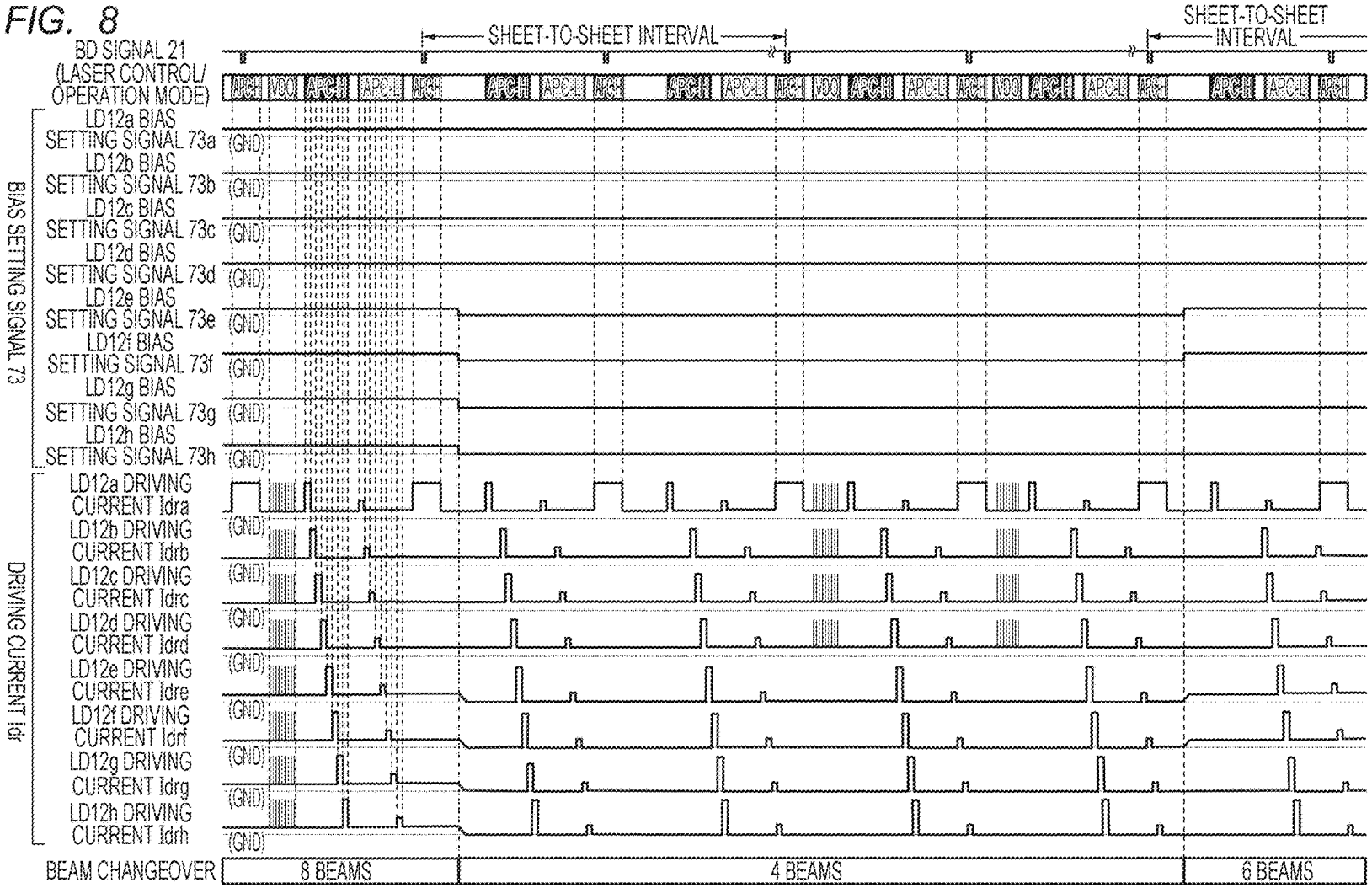
FIG. 8 is a timing chart for illustrating a relation between a bias setting signal and a drive current in the second embodiment.

FIG. 8 is a timing chart for illustrating a relation between the bias setting signals 73 (73*a* to 73*h*) and the driving currents Idr (Idra to Idrh) in the second embodiment. In the timing chart of FIG. 8, the light intensity control portions 30 (30*a* to 30*h*) of all light emitting points 12 (12*a* to 12*h*) of the LD 12 that are illustrated in FIG. 7 execute the upper light intensity control mode (APC-H), the lower light intensity control mode (APC-L), and the constant-current control mode (VDO). The bias setting signals 73 (73*a* to 73*h*) are switched in a sheet-to-sheet interval where an image is not formed. In the timing chart of FIG. 8, the LD 12 first emits eight light beams from the eight light emitting points 12*a* to 12*h* to form an image. The LD 12 next emits four light beams to form an image by switching from the eight light emitting points 12*a* to 12*h* to four light emitting points 12*a* to 12*d*. Lastly, the LD 12 switches from four light emitting points 12*a* to 12*d* to six light emitting points 12*a* to 12*f*.

When four light beams are emitted to form an image, the bias setting circuit 72, which serves as a light emitting point selecting unit, outputs the bias setting signals 73*e*, 73*f*, 73*g*, and 73*h* having values that set the coefficient β to substantially 0 (zero) for the light emitting points 12*e*, 12*f*, 12*g*, and 12*h*, which are not used. This reduces the bias currents Ibe, Ibf, Ibg, and Ibh of the drive currents Idre, Idrf, Idrg, and Idrh at the light emitting points 12*e*, 12*f*, 12*g*, and 12*h*.

When six light beams are emitted to form an image, the bias setting circuit 72, which serves as a light emitting point selecting unit, outputs the bias setting signals 73*g* and 73*h* having values that set the coefficient β to substantially 0 (zero) for the light emitting points 12*g* and 12*h*, which are not used. This reduces the bias currents Ibg and Ibh of the drive currents Idrg and Idrh at the light emitting points 12*g* and 12*h*.

In this manner, the bias setting circuit 72, which serves as a light emitting point selecting unit, can reduce the bias current Ib of a light emitting point that is not used, and accordingly switch the number of light beams of the LD 12 without changing the operation mode of the LD 12. In addition, with the bias current Ib lowered at a light emitting point that is not used, the relevant light intensity control portion 30 is reduced in power consumption.

According to the second embodiment, power consumption can be reduced by switching the number of light beams emitted from the LD 12 configured to emit a plurality of light beams, in a manner that decreases the supply of the bias current Ib to a light emitting point that is not used. According to the second embodiment, a variable amount of bias current can be supplied to a light source.

[Third Embodiment]

Next, a third embodiment will be described. In the third embodiment, the same structures as those of the first embodiment or the second embodiment are denoted by the same reference symbols, and descriptions thereof are omitted. The image forming apparatus 1 and the light scanning apparatus 2 according to the third embodiment are the same as those of the first embodiment, and hence descriptions thereof are omitted. A laser drive portion 311 of the third embodiment differs from the laser drive portion 211 of the second embodiment. The following description focuses on the laser drive portion 311 of the third embodiment.

Figure 9:
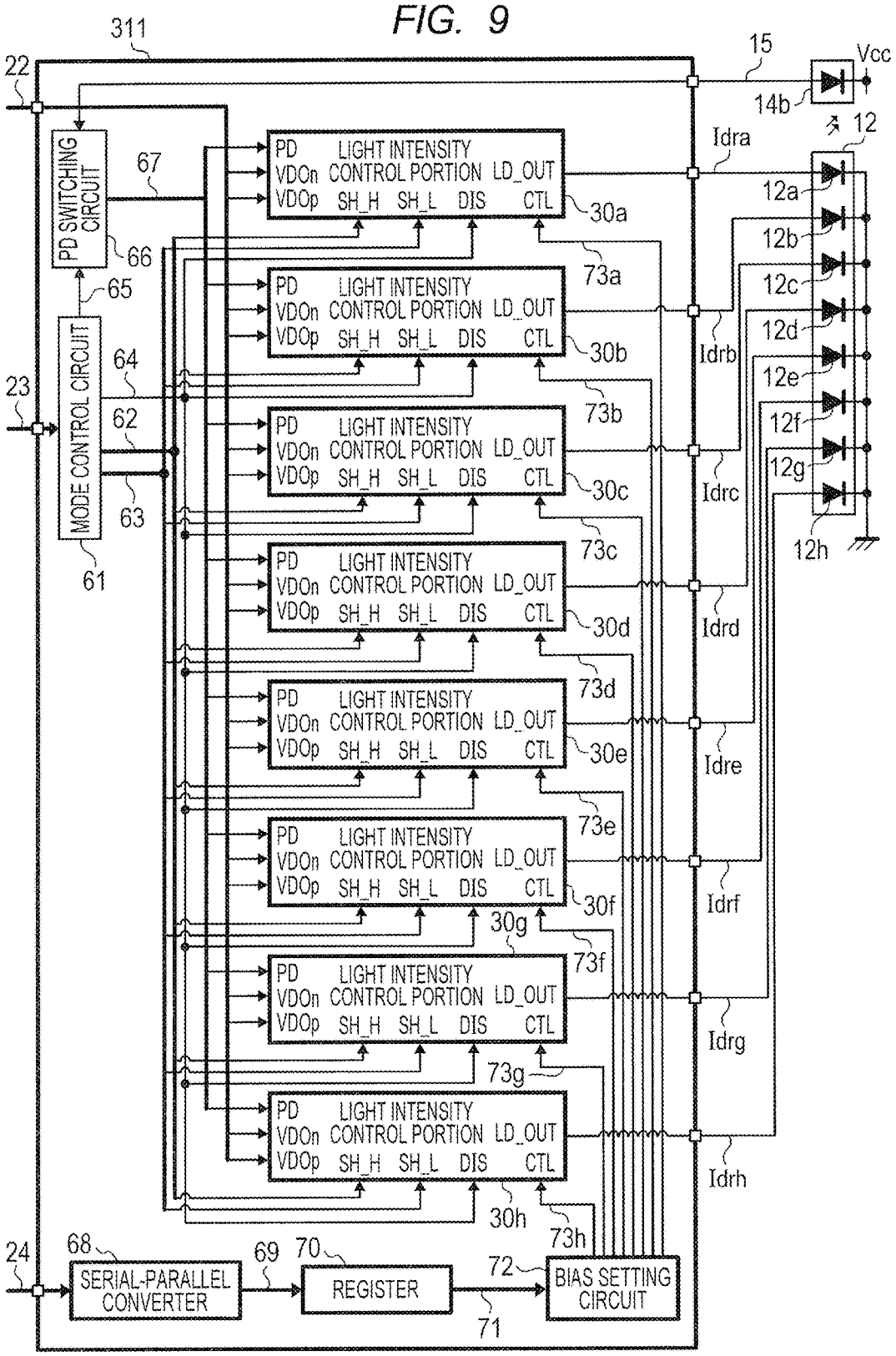
FIG. 9 is a block diagram of a laser drive portion according to a third embodiment.

FIG. 9 is a block diagram of the laser drive portion 311 according to the third embodiment. The laser drive portion 311 is provided on the laser drive circuit board 10 of each light scanning apparatus 2. The LD 12 in the third embodiment emits eight light beams, and has eight light emitting points 12*a*, 12*b*, 12*c*, 12*d*, 12*e*, 12*f*, 12*g*, and 12*h*. The LD 12 may instead be configured to have as many light emitting points as needed to emit nine or more light beams, or seven or less light beams.

A plurality of light intensity control portions 30 (30*a*, 30*b*, 30*c*, 30*d*, 30*e*, 30*f*, 30*g*, and 30*h*) connected to the plurality of light emitting points 12*a* to 12*h* of the LD 12 are the same as the light intensity control portion 30 of the first embodiment which is illustrated in FIG. 2, and therefore a description thereof is omitted. The light intensity control portions 30 (30*a* to 30*h*) may be the same as the light intensity control portion 130 according to the modification example of the first embodiment.

The laser drive portion 311 of the third embodiment differs from the laser drive portion 211 of the second embodiment in that the laser drive portion 311 of the third embodiment includes a serial-parallel converter 68 and a register (storage portion) 70. The serial-parallel converter 68 is configured to store in the register 70 a value (control signal) 69, which is transmitted by a serial signal 24 input from the image control portion 501. The value 69 transmitted by the serial signal 24 includes the coefficient α or β that is used to set the bias current Ib for each of the light emitting points 12*a* to 12*h* of the LD 12 separately.

The register 70 is configured to generate the bias control signal 71 based on the value 69. The bias control signal 71 is input to the bias setting circuit 72. The bias setting circuit 72 is configured to generate the bias setting signals 73 (73*a* to 73*h*) based on the value 69 stored in the register 70. The bias setting circuit 72 outputs the bias setting signals 73*a* to 73*h* to the light intensity control portions 30*a* to 30*h*, respectively. The plurality of light intensity control portions 30*a* to 30*h* can change the bias currents Iba to Ibh based on the bias setting signals 73*a* to 73*h*, respectively. This enables the bias setting circuit 72 to supply the bias current Ib to the plurality of light emitting points 12*a* to 12*h* independently of one another in a variable amount that is varied depending on image forming conditions, which include the light emission conditions of the plurality of light emitting points 12*a* to 12*h* and environmental conditions.

According to the third embodiment, the image control portion 501 can write, in the register 70, with the use of the serial signal 24, information about which light emitting point in the LD 12 is to receive the bias current Ib that is changed. The bias current Ib can therefore be changed for each of the plurality of light emitting points of the LD 12, from outside of the laser drive portion 311.

According to the third embodiment, a bias current can be supplied in a variable amount to each of the plurality of light emitting points of the LD 12 independently of one another. According to the third embodiment, a variable amount of bias current can be supplied to a light source.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-114398, filed Jun. 8, 2016, which is hereby incorporated by reference herein in its entirety.

What is claimed is:

1. An image forming apparatus, comprising:

a photosensitive member;

a charging unit configured to charge the photosensitive member;

a light scanning apparatus configured to emit a plurality of light beams to form an electrostatic latent image on a surface of the photosensitive member;

a developing unit configured to develop the electrostatic latent image to form, on the surface of the photosensitive member, a toner image to be transferred onto a recording medium; and an image control portion configured to control the light scanning apparatus, the light scanning apparatus comprising:

a light source comprising a plurality of light emitting points in order to emit a plurality of light beams;

a light intensity detection portion configured to detect a light intensity of each of the plurality of light beams;

a plurality of light intensity control portions provided corresponding to the plurality of light emitting points, respectively, in order to control the light intensity of each of the plurality of light beams based on a corresponding detection result of the light intensity detection portion, each of the plurality of light intensity control portions being configured to supply, in advance, to a corresponding light emitting point of the plurality of light emitting points, a bias current equal to or less than a threshold current at which the corresponding light emitting point starts emitting light, and supply, to the corresponding light emitting point, a switching current superposed on the bias current, the switching current being modulated in order to control light emission of the corresponding light emitting point in accordance with an image signal; and a bias current setting unit configured to output, for each of the plurality of light emitting points, a bias setting signal, which is used to set the bias current to be supplied to the corresponding light emitting point of the plurality of light emitting points, based on a control signal from the image control portion, wherein each of the plurality of light intensity control portions comprises a bias current changing unit configured to change the bias current to be supplied to the corresponding light emitting point in accordance with the bias setting signal from the bias current setting unit, wherein the image control portion controls the plurality of light intensity control portions so that each of the plurality of light intensity control portions operates in a first mode, in which a driving current to be supplied to the corresponding light emitting point is adjusted in order to emit a light beam having a first light intensity from the corresponding light emitting point, and in a second mode, in which a driving current to be supplied to the corresponding light emitting point is adjusted in order to emit a light beam having a second light intensity from the corresponding light emitting point, the second light intensity being lower than the first light intensity, and wherein the bias current changing unit changes the bias current to be supplied to the corresponding light emitting point in accordance with the bias setting signal from the bias current setting unit even when the plurality of light intensity control portions are controlled by the image control portion so as to operate in the first mode and the second mode.

2. An image forming apparatus according to claim 1, wherein the bias current changing unit changes the bias current to be supplied to the corresponding light emitting point in accordance with the bias setting signal from the bias current setting unit between a formation of an electrostatic latent image for a toner image that is to be transferred onto one recording medium and a formation of an electrostatic latent image for a toner image that is to be transferred onto a next recording medium.

3. An image forming apparatus according to claim 1, wherein the light scanning apparatus further comprises a storage portion configured to store the control signal from the image control portion, and wherein the bias current setting unit outputs the bias setting signal based on the control signal stored in the storage portion.

* * * * *